US007059946B1

(12) United States Patent
Obeng et al.

(10) Patent No.: US 7,059,946 B1
(45) Date of Patent: Jun. 13, 2006

(54) COMPACTED POLISHING PADS FOR IMPROVED CHEMICAL MECHANICAL POLISHING LONGEVITY

(75) Inventors: Yaw S. Obeng, Frisco, TX (US); Peter A. Thomas, Miramar, FL (US); Patrick J. Kelly, Orlando, FL (US)

(73) Assignee: PsiloQuest Inc., Orlando, FL (US)

( * ) Notice: Subject to any disclaimer, the term of this patent is extended or adjusted under 35 U.S.C. 154(b) by 0 days.

(21) Appl. No.: 11/110,035

(22) Filed: Apr. 20, 2005

Related U.S. Application Data

(60) Continuation-in-part of application No. 10/641,866, filed on Aug. 15, 2003, which is a continuation of application No. 10/241,074, filed on Sep. 11, 2002, now Pat. No. 6,706,383, which is a continuation-in-part of application No. 09/994,407, filed on Nov. 27, 2001, now Pat. No. 6,579,604, said application No. 11/110,035 and a continuation-in-part of application No. 10/000,101, filed on Oct. 24, 2001, now Pat. No. 6,846,225, and a continuation-in-part of application No. 10/727,058, filed on Dec. 3, 2003, now abandoned, is a division of application No. 10/241,985, filed on Sep. 12, 2002, now Pat. No. 6,684,704, which is a continuation-in-part of application No. 09/998,471, filed on Nov. 29, 2001, now Pat. No. 6,596,388, said application No. 09/994,407.

(60) Provisional application No. 60/304,375, filed on Jul. 10, 2001, provisional application No. 60/295,315, filed on Jun. 1, 2001, provisional application No. 60/250,299, filed on Nov. 29, 2000.

(51) Int. Cl.
*B24B 1/00* (2006.01)

(52) U.S. Cl. ..... 451/285; 451/41; 451/60; 451/290; 428/304.4; 428/314.4; 204/159.17; 51/298

(58) Field of Classification Search ..... 451/41, 451/60, 285, 290; 51/298; 428/304.1, 314.4; 204/159.17
See application file for complete search history.

(56) References Cited

U.S. PATENT DOCUMENTS

| | | | |
|---|---|---|---|
| 4,168,353 | A | 9/1979 | Kitamori |
| 4,272,924 | A | 6/1981 | Masuko et al. |
| 4,346,142 | A | 8/1982 | Lazear |

(Continued)

FOREIGN PATENT DOCUMENTS

| | | |
|---|---|---|
| EP | 0104608 | 4/1984 |

(Continued)

OTHER PUBLICATIONS

M.A. Rodriguez-Perez, A. Duljsens and J.A. De Saja; "Effect of Addition of EVA on the Technical Properties of Extruded Foam Profiles of Low-Density Polyethylene/EVA Blends"; Effects of Eva on Properties of LDPE/EVA Blends; Oct. 1997; pp.1237-1244.

(Continued)

*Primary Examiner*—Lee D. Wilson
*Assistant Examiner*—Anthony Ojini

(57) ABSTRACT

The present invention is directed, in general, to a chemical mechanical polishing pad comprising a polishing body and a backing material coupled to the polishing body. The polishing body comprising a compacted thermoplastic foam substrate, wherein the compacted thermoplastic foam substrate has a density that is as at least about 1.1 times greater than an uncompacted thermoplastic foam substrate density. Other aspects of the invention comprise a method for manufacturing the above-described chemical mechanical polishing pad and chemical mechanical polishing apparatus comprising the chemical mechanical polishing pad.

21 Claims, 10 Drawing Sheets

U.S. PATENT DOCUMENTS 4,446,254 A 5/1984 Nakae et al.
4,613,345 A 9/1986 Thicke et al.
4,703,656 A 11/1987 Bhardwaj
4,845,132 A 7/1989 Masuoka et al.
4,852,646 A 8/1990 Dittmer et al.
4,946,903 A 8/1990 Gardella, Jr. et al.
5,266,309 A 11/1993 Gardella, Jr. et al.
5,332,943 A 7/1994 Bhardwaj
5,461,101 A 10/1995 Rothon et al.
5,510,174 A 4/1996 Litman
5,516,400 A * 5/1996 Pasch et al. ..... 438/117
5,578,362 A 11/1996 Reinhardt et al.
5,624,303 A 4/1997 Robinson
5,627,079 A 5/1997 Gardella, Jr. et al.
5,696,207 A 12/1997 Vargo et al.
5,814,567 A 9/1998 Yahiaoui et al.
5,945,486 A 8/1999 Vargo et al.
5,993,917 A 11/1999 Pan et al.
6,045,434 A 4/2000 Fisher et al.
6,051,500 A 4/2000 Maury et al.
6,063,306 A 5/2000 Kaufman et al.
6,083,838 A 7/2000 Burton et al.
6,099,954 A 8/2000 Urbanavage et al.
6,132,298 A 10/2000 Zunizna et al.
6,150,271 A 11/2000 Easter et al.
6,186,864 B1 2/2001 Fisher et al.
6,231,942 B1 5/2001 Blizard et al.
6,264,532 B1 7/2001 Meloni
6,267,644 B1 7/2001 Molnar
6,283,829 B1 9/2001 Molnar
6,290,589 B1 9/2001 Tolles
6,291,349 B1 9/2001 Molnar
6,293,851 B1 9/2001 Molnar
6,300,386 B1 10/2001 Karukaya et al.
6,311,573 B1 11/2001 Bhardwaj
6,328,634 B1 12/2001 Shen et al.
6,343,510 B1 2/2002 Neeson et al.
6,346,202 B1 2/2002 Molnar
6,354,915 B1 3/2002 James et al.
6,368,200 B1 4/2002 Merchant et al.
6,371,833 B1 * 4/2002 Huckels et al. ..... 451/41
6,413,153 B1 7/2002 Molnar
6,419,556 B1 7/2002 Urbanavage et al.
6,425,803 B1 7/2002 Baker, III
6,425,816 B1 7/2002 Roberts et al.
6,428,388 B1 8/2002 Molnar
6,435,948 B1 8/2002 Molnar
6,585,574 B1 7/2003 Lombardo et al.
6,616,516 B1 * 9/2003 Ravkin et al. ..... 451/194
6,663,480 B1 * 12/2003 Jeong et al. ..... 451/526
2002/0098789 A1 7/2002 Burke
2002/0115734 A1 8/2002 Bruxvoort

FOREIGN PATENT DOCUMENTS

EP 01 64776 3/1989
EP 0352199 1/1990
EP 08 078369 3/1996
EP 0884349 A1 12/1998
GB 1338647 11/1973
JP 58 064948 4/1983
JP 9132661 5/1997
JP 11 245164 9/1999
JP 2002036098 2/2002
WO WO96/05602 A1 2/1996
WO WO96/23834 8/1996
WO WO 99/10129 3/1999
WO WO99/62673 12/1999

OTHER PUBLICATIONS

David G. Totzka; "Ultrasound Diagnostic of Chemical Mechanical Planarization Pads"; Aug. 2000; p. 1-62.
Encyclopedia of Smart Materials, 2 Volume Set; Mar. 2002.
D.G. Totzke, A. Belyaev, W. Moreno, S. Ostapenko, I. Tarasov, W. Easter, A. Maury, and A. Cravasse; "Non-Destructive Characterization of CMP Pads Using Scanning Ultrasonic Transmission"; AIP Conference Proceedings, American Institute of Physics, 1970, pp. 259-262.
N. J. Mills, et al. "Modelling the gas-loss creep mechanism in EVA foam from running shoes"; Cellular Polymers, 20, (2001) 79-100, pp. 1-16.

* cited by examiner (B)

(A)

COMPACTED POLISHING PADS FOR IMPROVED CHEMICAL MECHANICAL POLISHING LONGEVITY

CROSS-REFERENCE TO RELATED APPLICATIONS

This application is a continuation-in-part of U.S. patent application Ser. No. 10/641,866, entitled "A POLISHING PAD SUPPORT THAT IMPROVES POLISHING PERFORMANCE AND LONGEVITY," to Yaw S. Obeng and Peter Thomas, filed on Aug. 15, 2003, which in turn is a continuation of U.S. patent application Ser. No. 10/241,074, now U.S. Pat. No. 6,706,383, entitled, "A POLISHING PAD SUPPORT THAT IMPROVES POLISHING PERFORMANCE AND LONGEVITY," to Yaw S. Obeng and Peter Thomas, filed on Sep. 11, 2002, which in turn, is a continuation-in-part of U.S. patent application Ser. No. 09/994,407, now U.S. Pat. No. 6,579,604, entitled, "A METHOD OF ALTERING AND PRESERVING THE SURFACE PROPERTIES OF A POLISHING PAD AND SPECIFIC APPLICATIONS THEREFOR," to Yaw S. Obeng and Edward M. Yokley, filed on Nov. 27, 2001; a continuation-in-part of U.S. patent application Ser. No. 10/000,101, entitled, THE SELECTIVE CHEMICAL-MECHANICAL POLISHING PROPERTIES OF A CROSS LINKED POLYMER AND SPECIFIC APPLICATIONS THEREFOR, to Yaw S. Obeng and Edward M. Yokley, filed on Oct. 24, 2001 now U.S. Pat. No. 6,846,255; and a continuation-in-part of U.S. patent application Ser. No. 10/727,058, entitled MEASURING THE SURFACE PROPERTIES OF POLISHING PAD USING ULTRASONIC REFLECTANCE, to Yaw S. Obeng, filed on Dec. 3, 2003 now abandoned, which, in turn, is a divisional patent application of U.S. patent application Ser. No. 10/241,985, now U.S. Pat. No. 6,684,704, entitled, MEASURING THE SURFACE PROPERTIES OF POLISHING PAD USING ULTRASONIC REFLECTANCE, to Yaw S. Obeng, filed on Sep. 12, 2002, which, in turn, is a continuation-in-part of the above-mentioned U.S. patent application Ser. Nos. 10/000,101 and 10/241,074, as well as, U.S. patent application Ser. No. 09/998,471, now U.S. Pat. No. 6,596,388, entitled, "A METHOD OF INTRODUCING ORGANIC AND INORGANIC GRAFTED COMPOUNDS THROUGHOUT A THERMOPLASTIC POLISHING PAD USING A SUPERCRITICAL FLUID AND APPLICATIONS THEREFOR," to Edward M. Yokley and Yaw S. Obeng, filed on Nov. 29, 2001; both of U.S. patent application Ser. Nos. 09/994,407 and 10/000,101, in turn, claim the benefit of U.S. Provisional Application 60/250,299 entitled "SUBSTRATE POLISHING DEVICE AND METHOD," to Edward M. Yokley, filed on Nov. 29, 2000; U.S. Provisional Application 60/295,315 entitled, "A METHOD OF ALTERING PROPERTIES OF A POLISHING PAD AND SPECIFIC APPLICATIONS THEREFOR," to Yaw S. Obeng and Edward M. Yokley, filed on Jun. 1, 2001; and U.S. Provisional Application 60/304,375 entitled, "A METHOD OF ALTERING PROPERTIES OF A THERMOPLASTIC FOAM POLISHING PAD AND SPECIFIC APPLICATIONS THEREFOR," to Yaw S. Obeng and Edward M. Yokley, filed on Jul. 10, 2001; all which are commonly assigned with the present invention and incorporated herein by reference as if reproduced herein in its entirety.

TECHNICAL FIELD OF THE INVENTION

The present invention is directed to chemical mechanical polishing for creating a smooth, ultra-flat surface on such items as glass, semiconductors, dielectrics, metals, barrier layers and composites thereof, magnetic mass storage media and integrated circuits. More specifically, the invention is directed to a chemical mechanical polishing pad.

BACKGROUND OF THE INVENTION

Chemical mechanical polishing (CMP) has been successfully used for planarizing both metal and dielectric films. In one plausible mechanism of planarizing, the polishing process is thought to involve intimate contact between high points on the wafer surface and the pad material, in the presence of slurry. In this scenario, corroded materials, produced from reactions between the slurry and wafer surface being polished, are removed by shearing at the pad-wafer interface. The elastic properties of pad material significantly influence the final planarity and polishing rate. In turn, the elastic properties are a function of both the intrinsic polymer and its foamed structure.

Historically, polyurethane-based pads have been used for CMP because of their high strength, hardness, modulus and high elongation at break. While such pads can achieve both good uniformity and efficient topography reduction, their ability to rapidly and uniformly remove surface materials drops off rapidly as a function of use. The drop off in material removal rates as a function of time observed for polyurethane-based pads has been attributed to changes in the mechanical response of such polishing pads under conditions of critical shear. It is generally believed that the loss in functionality of polyurethane-based CMP pads is due to pad decomposition from the interaction between the pad and the slurries used in the polishing.

Moreover, decomposition produces a surface modification in and of itself in the case of the polyurethane pads which can be detrimental to uniform polishing. Alternatively, in some instances, the surface modification of materials used for CMP polishing pads may improve the application performance. Such modifications, however are temporary, thus requiring frequency replacement or retreatment of the CMP pad. Polyurethane pads also generally require a break-in period before polishing, in addition to reconditioning and pretreatment after a period of use. It is often also necessary to keep traditional pads wet while polishing equipment is in idle mode. All of these characteristics undesirably reduce the overall efficiency of CMP when using polyurethane or similar conventional pads.

Accordingly, what is needed is an improved CMP pad capable of providing a highly planar surface during CMP and having improved longevity, while not experiencing the above-mentioned problems.

SUMMARY OF THE INVENTION

To address the above-discussed deficiencies of the prior art, the present invention provides in one embodiment, a chemical mechanical polishing pad comprising a polishing body and a backing material coupled to the polishing body. The polishing body comprises a compacted thermoplastic foam substrate, wherein the compacted thermoplastic foam substrate has a density that is as at least about 1.1 times greater than an uncompacted thermoplastic foam substrate density.

Another embodiment of the present invention is directed to a method for preparing a chemical mechanical polishing pad. The method includes providing an uncompacted thermoplastic foam substrate and compressing the uncompacted thermoplastic foam substrate to form a compacted thermoplastic foam substrate. Compression is such that the compacted thermoplastic foam substrate has a density that is as at least about 1.1 times greater than the uncompacted thermoplastic foam substrate.

Still another embodiment is a polishing apparatus. The polishing apparatus includes a mechanically driven carrier head, a polishing platen, a polishing pad attached to the polishing platen. The carrier head is positionable against the polishing platen to impart a polishing force against the polishing platen. The polishing pad includes a polishing body comprising a compacted thermoplastic foam substrate that has a density that is at least about 1.1 times greater than an uncompacted thermoplastic foam substrate density.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the scope of the invention.

BRIEF DESCRIPTION OF THE DRAWINGS

For a more complete understanding of the present invention, reference is now made to the following descriptions taken in conjunction with the accompanying drawings, in which:

FIG. 6 presents exemplary data to illustrate the relationship between the mean acoustic transmittance of different polishing pads and the down force (DF) and dwell time (DT) that the polishing pads were subjected to;

DETAILED DESCRIPTION

The present invention benefits from the previously unrecognized advantages of using a compacted thermoplastic foam substrate as the polishing body in a CMP pad. The term compacted means that a sustained pressure is applied to the flat surface of the pad for a sufficient period to increase the density of the polishing body permanently (e.g., throughout the useful working lifetime of the polishing body). It was discovered that polishing bodies made of compacted thermoplastic foam substrates can provide superior uniform removal rates longer than polishing bodies made of the same uncompacted thermoplastic.

Figure 1:
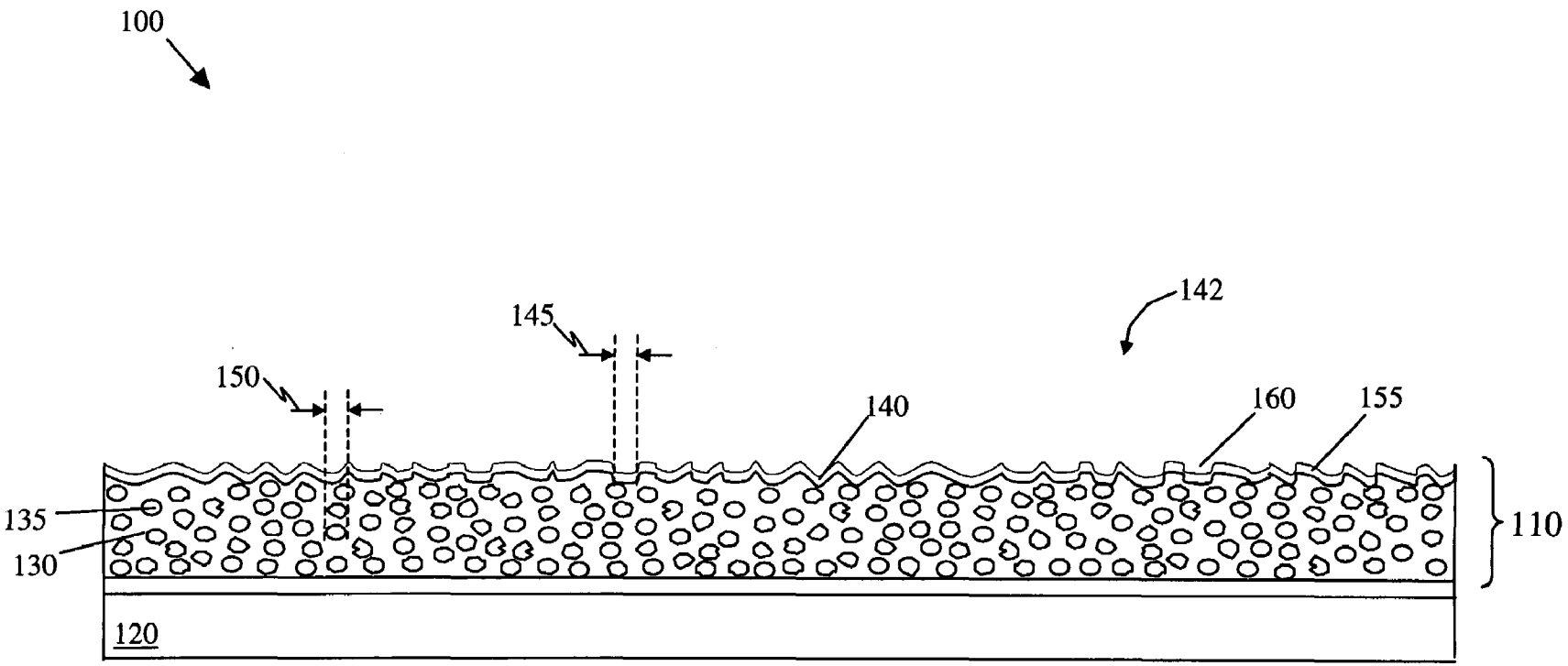
FIG. 1 presents an exemplary chemical mechanical polishing pad of the present invention.

One embodiment of the present invention is a polishing pad. FIG. 1 presents an exemplary polishing pad 100 of the present invention. The polishing pad 100 can include a polishing body 110 and a backing material 120 coupled to the polishing body 110. In some preferred embodiments, the backing material 120 is a stiff backing material. A stiff backing 120 limits the compressibility and elongation of the foam 130 during polishing, which in turn, reduces erosion and dishing effects during metal polishing via CMP. In certain preferred embodiments, the stiff backing material 120 comprises a high-density polyethylene (i.e., greater than about 0.98 gm/cc), and more preferably, a condensed high-density polyethylene. Of course, other high-density polymers can be used as the backing material 120.

The polishing body 110 comprises a compacted thermoplastic foam substrate 130. The compacted thermoplastic foam substrate 130 has a density that is as at least about 1.1 times greater than an uncompacted thermoplastic foam substrate density. In some advantageous embodiments, the density of the compacted thermoplastic foam substrate 130 is at least about 2 times greater, and even more preferably between about 4 and about 9 times greater than an uncompacted thermoplastic foam substrate density. In some cases, the density of the compacted thermoplastic foam substrate 130 is between about 1 $lb/ft^3$ and about 25 $lb/ft^3$, and more preferably, between about 5 $lb/ft^3$ and about 15 $lb/ft^3$.

One of ordinary skill in the art would understand that numerous empirical methods can be used to measure the density of the thermoplastic foam substrate 130. In some instances, for example, it is advantageous to use an acoustic transmittance signal, such as described in the above-mentioned U.S. patent application Ser. No. 10/727,058. Measurements using acoustic transmittance have the advantage of being rapid, readily automated and easily coupled to a process for producing the polishing pads. Of course, the density of the polishing body 110 or polishing pad 100 could also be determined by measuring the volume and weight of the thermoplastic foam substrate 130.

In some cases, it is desirable for the compacted thermoplastic foam substrate 130 to comprise a closed-cell foam of crosslinked homopolymer or copolymers. The term cell 135 as used herein, refers to any volume defined by a membrane within the substrate 130 occupied by air, or other gases used as blowing agents, defining a substantially concave cell 140 formed upon skiving of the substrate 130. The concave cell 140 need not have smooth or curved walls. Rather, the concave cells 140 may have irregular shapes and sizes. Several factors, such as the composition of the substrate and the procedure used to prepare the foam substrate 130, may affect the shape and size of the concave cells 140.

The term skiving as used herein means any process to a cut away a thin layer of the surface 142 of the substrate 130 so as to expose concave cells 140 within the thermoplastic foam substrate 130. Skiving may be achieved using any conventional technique well know to one of ordinary skill in the art.

More preferably, the cells 135 of the closed-cell thermoplastic foam substrate 130 are substantially devoid of a blowing agent. Any conventional blowing agent can be used to prepare the thermoplastic foam substrate 130, including fluorocarbons, carbon dioxide, nitrogen ($N_2$), air, or other conventional blowing agent gases. Naturally, an uncompacted thermoplastic foam substrate has these gases within its cells. After being compressed, the closed-cells 135 of the compacted thermoplastic foam substrate 130 lose at least about 90 percent of the blowing agent, and more preferably at least about 99 percent, as compared to the amounts of blowing agent present in the uncompacted thermoplastic foam substrate. In other embodiments, however, the thermoplastic foam substrate 130 can comprise an open-celled foam of crosslinked homopolymer or copolymers.

In certain embodiments, the thermoplastic foam substrate 130 may comprise cross-linked polyolefins, such as polyethylene, polypropylene, and combinations thereof. In certain preferred embodiments, the thermoplastic foam substrate 130 comprises a closed-cell foam of crosslinked homopolymer or copolymers. Examples of closed-cell foam crosslinked homopolymers comprising polyethylene (PE) include: Volara™ and Volextra™ from Voltek (Lawrence, Mass.); Aliplast™, from JMS Plastics Supply, Inc. (Neptune, N.J.); or Senflex T-Cell™ (Rogers Corp., Rogers, Conn.). Examples of closed-cell foams of crosslinked copolymers comprising polyethylene and ethylene vinyl acetate (EVA) include: Volara™ and Volextra™ (from Voltek Corp.); Senflex EVA™ (from Rogers Corp.); and J-foam™ (from JMS Plastics JMS Plastics Supply, Inc.).

In other preferred embodiments, the closed-cell foam comprises a blend of crosslinked ethylene vinyl acetate copolymer and a low-density polyethylene copolymer (preferably between about 0.1 and about 0.3 gm/cc). In yet other advantageous embodiments, the blend has an ethylene vinyl acetate:polyethylene weight ratio between about 1:9 and about 9:1. In certain preferred embodiments, the blend comprises EVA ranging from about 5 to about 45 wt %, preferably about 6 to about 25 wt % and more preferably about 12 to about 24 wt %. Such blends are thought to be conducive to the desirable production of concave cells having a small size as further discussed below. In still more preferred embodiments, the blend has an ethylene vinyl acetate:polyethylene weight ratio between about 0.6:9.4 and about 1.8:8.2. In even more preferred embodiments, the blend has an ethylene vinyl acetate:polyethylene weight ratio between about 0.6:9.4 and about 1.2:8.8.

In yet other advantageous embodiments, the thermoplastic foam substrate 130 may be characterized as having at least about 85 wt % Xylene insoluble material. The process for measuring Xylene insoluble materials is well known to those of ordinary skill in the art. Such processes may involve, for example, digestion of the blend in Xylene for 24 hours at 120° C. followed by drying and comparing the weight of the residual insoluble material to the predigestion material.

In certain embodiments, the thermoplastic foam substrate 130 has cells 135 formed throughout the substrate. In certain preferred embodiments, the cells 135 are substantially spheroidal. In other preferred embodiments, the size of the cells are such that, on skiving the substrate 130, cells 135 of the substrate 130 have an average size 145 between about 5 microns and about 600 microns. In some cases, the average size 145 ranges from about 100 to about 350 microns, preferably about 100 to about 250 microns and more preferably about 115 to about 200 microns. In other cases, for instances, where a harder polishing surface is desired, the concave cells 140 have an average size 145 of between 5 and 100 microns and more preferably, between about 5 microns and about 25 microns. Cell size 145 may be determined using standardized protocols, developed and published by the American Society for Testing and Materials (West Conshohocken, Pa.), for example, such as ASTM D3576, incorporated herein by reference.

In some preferred embodiments, on skiving the substrate 130, the open concave cells 140 formed at the surface 142 of the substrate 130 are substantially the same as the size 150 of the cells 135 formed throughout the substrate 130. In certain preferred embodiments, where the shape of the cell 135 is substantially spherical, cell size 145 is approximately equal to the mean cell diameter 150. In embodiments, comprising EVA copolymer, for example, cell diameter 150 is a function of the EVA content of the co-polymer bend, as disclosed by Perez et al. J. Appl. Polymer Sci., vol. 68, 1998 pp 1237–1244, incorporated by reference herein. As disclosed by Perez et al. bulk density and cell density are inversely related. Thus, in certain preferred embodiments, the density of concave cells 140 at the surface 142 of the substrate 130 ranges between 2.5 and about 100 cells/$mm^2$, and more preferably, between about 60 and 100 cells/$mm^2$. Cell density may be determined, for example, from visual inspection of microscopic images of the substrate's surface 142.

The thermoplastic foam substrate 130 may further comprise up to about 25 wt % of an inorganic filler material. The inorganic filler can comprise any Group I, Group II or Transition Metal element, or compounds thereof, that are well known to those of ordinary skill in the art to impart desirable translucence, color or lubricant properties to the foam substrate 130. For example, the inorganic filler may be selected from the group consisting of talc, titanium oxides, calcium silicates, calcium carbonate, magnesium silicates, and zinc salts. The thermoplastic foam substrate 130, in certain preferred embodiments, comprises about 17 wt % talc. In other embodiments, the filler comprises silica (about 20 to about 25 wt %), zinc oxides (about 1 wt %), stearic acid (about 1 wt %), and other additives and pigments (up to about 2%) well known to those of ordinary skill in the art. Other conventional filler materials, such as that revealed in U.S. Pat. Nos. 6,425,816 and 6,425,803, incorporated by reference herein, are also within the scope of the present invention.

The thermoplastic foam substrate 130 also desirably has certain mechanical properties to facilitate polishing. Specifically, the thermoplastic foam substrate 130 must be capable of deforming during polishing to an extent sufficient to allow polishing agent coating the interior surface of the concave cells to facilitate polishing. In certain embodiments, for example, the thermoplastic foam substrate 130 has a Tensile Elongation between about 100% and about 800%. In certain preferred embodiments, Tensile Elongation is between about 100% and about 450%. In yet other embodiments, Tensile Elongation is between about 600% and about 800%. Tensile Elongation may be determined using standard protocols, such as ASTM D3575, incorporated herein by reference.

In some preferred embodiments, the thermoplastic foam substrate 130 further includes a surface 142 comprising concave cells 140, and more preferably, a polishing agent 155 coating an interior surface 160 of the concave cells 140. The polishing agent 155 advantageously tunes the surface hardness of the polishing pad 100 to that of the surface being polished. Of course other ways of tuning the surface hardness, such as choice of materials thermoplastic foam substrate (e.g., adjusting the PE-EVA ratio), fillers amount and concentration, etc . . . , are also within the scope of the invention.

The interior surface 160 of the concave cells 140 form excellent receptacles for receiving a uniform coating of the polishing agent 155. Though not limiting the scope of the present invention by theory, it is hypothesized that the center of the concave cell 140 serves as an excellent nucleating point for coating because the surface energy of the cell 140 at the center is lowest. It is believed that the initiation of coating at this location facilitates the uniform coverage of the interior surface of the concave cell 160 with the polishing agent 155, thereby facilitating the polishing performance of a pad 100 having such a surface.

The polishing agent 155 can comprise one or more ceramic compounds, or one or more organic polymers, resulting from the grafting of the secondary reactants on the substrate's surface 142, as disclosed in the above-cited U.S. patent application Ser. No. 09/994,407. The polishing agent 155 can be an oxide, silicate or nitride of a transition metal. For instance, ceramic polishing agents 142 may comprise an inorganic metal oxide resulting when an oxygen-containing organometallic compound is used as the secondary reactant to produce a grafted surface. The secondary plasma mixture can include a transition metal such as titanium, manganese, or tantalum.

However, any metal element capable of forming a volatile organometallic compound, such as metal ester containing one or more oxygen atoms, and capable of being grafted to the polymer surface is suitable. Silicon may also be employed as the metal portion of the organometallic secondary plasma mixture. In these embodiments, the organic portion of the organometallic reagent may be an ester, acetate, or alkoxy fragment. In some preferred embodiments, the polishing agent can be silicon oxides and titanium oxides, tetraethoxy silane polymer; and titanium alkoxide polymer. Non-limiting examples include: $SiO_2$, $Ta_2O_5$, $TiO_2$, $Al_2O_3$, ZrO, $HfO_2$, $ZrSi_xO_y$ (where x is between ~0.1 and ~30, and y is ~0.1 and ~30), $HfSi_xO_y$ (where x is between ~0.1 and ~30, and y is ~0.1 and ~30), or a mixture thereof. In other instances, the polishing agent 155 is derived from a metalorganic reactant, such as tetraorthosilicate (TEOS), tetraisopropoxy titanium (IV), zirconium (IV) t-butoxide (ZTB) or a mixture thereof.

Numerous secondary reactants can be used to produce the ceramic polishing agent 155. The secondary plasma reactant can be ozone, alkoxy silanes, water, ammonia, alcohols, mineral sprits or hydrogen peroxide, for example. In some preferred embodiments, the secondary plasma reactant is composed of titanium esters, tantalum alkoxides, including tantalum alkoxides wherein the alkoxide portion has 1–5 carbon atoms; manganese acetate solution in water; manganese alkoxide dissolved in mineral spirits; manganese acetate; manganese acetylacetonate; aluminum alkoxides; alkoxy aluminates; aluminum oxides; zirconium alkoxides, wherein the alkoxide has 1–5 carbon atoms; alkoxy zirconates; magnesium acetate; and magnesium acetylacetonate. Other embodiments are also contemplated for the secondary plasma reactant, for example, alkoxy silanes and ozone, alkoxy silanes and ammonia, titanium esters and water, titanium esters and alcohols, or titanium esters and ozone.

Alternatively, the polishing agent 155 may comprise organic polymers where organic compounds are used as the secondary plasma reactant. Examples of such secondary reactants include: allyl alcohols; allyl amines; allyl alkylamines, where the alkyl groups contain 1–8 carbon atoms; allyl ethers; secondary amines, where the alkyl groups contain 1–8 carbon; alkyl hydrazines, where the alkyl groups contain 1–8 carbon atoms; acrylic acid; methacrylic acid; acrylic acid esters containing 1–8 carbon atoms; methacrylic esters containing 1–8 carbon atoms; or vinyl pyridine, and vinyl esters, for example, vinyl acetate. In certain preferred embodiments, the polishing agent 155 is selected from a group of polymers consisting of polyalcohols and polyamines.

Figure 2:
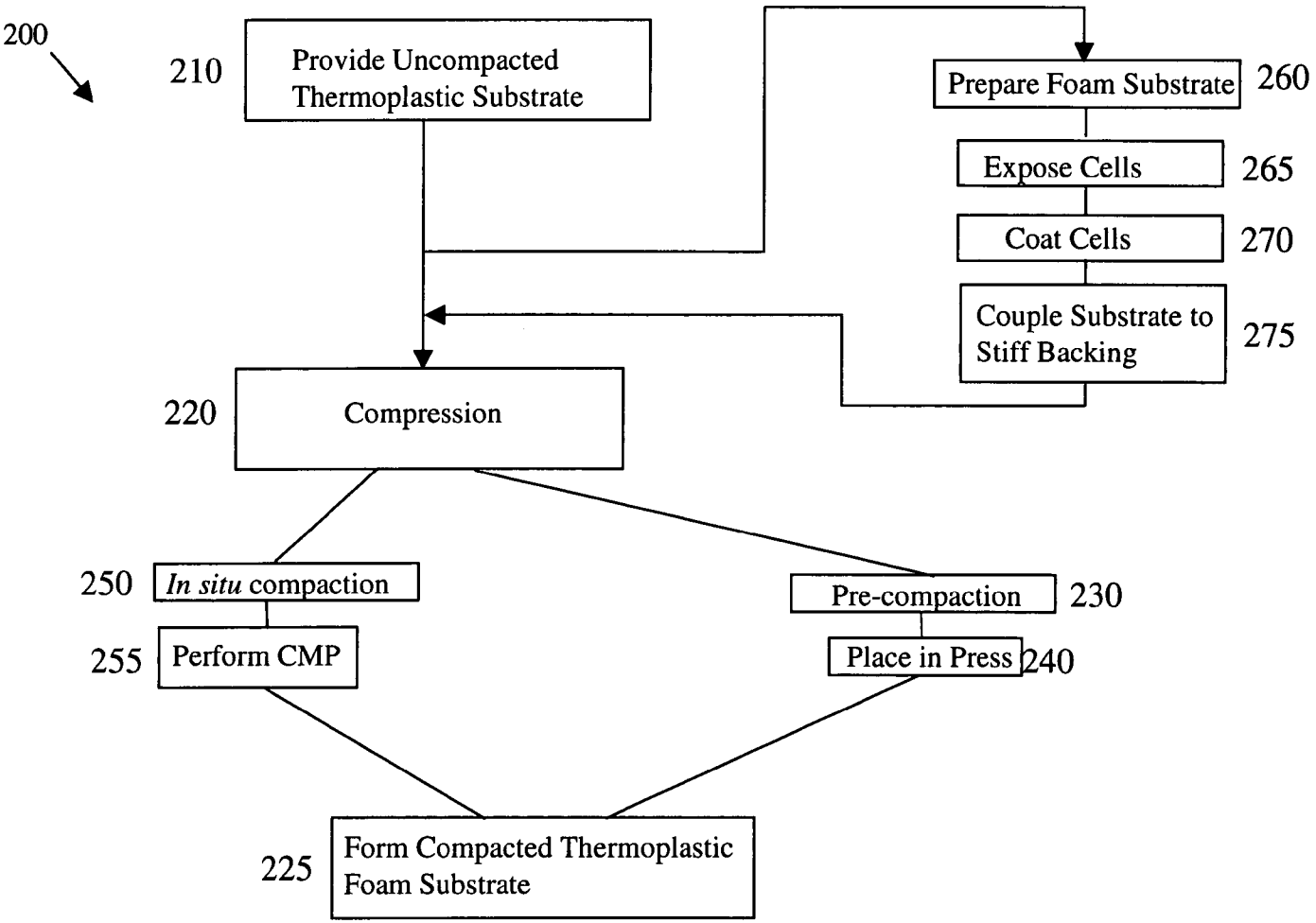
FIG. 2 illustrates, by flow diagram, a method for preparing a chemical mechanical polishing pad of the present invention.

Yet another embodiment of the present invention is a method for preparing a polishing pad. FIG. 2 illustrates, by flow diagram, a method 200 for preparing a polishing pad of the present invention. The method includes a step 210 of providing an uncompacted thermoplastic foam substrate and a step 220 of compressing the uncompacted thermoplastic foam substrate to form a compacted thermoplastic foam substrate in step 225. The compression step 220 is such that the compacted thermoplastic foam substrate has a density that is as at least about 1.1 times greater than the uncompacted thermoplastic foam substrate. As noted above, in certain preferred embodiments, the thermoplastic foam substrate serves as a polishing body for a polishing pad. The extent and timing of compaction can be adjusted according to the desired semiconductor wafer polishing specifications.

For instances, in some cases it is advantageous for the polishing body to be precompacted at step 230. Precompaction can be accomplished by putting the thermoplastic foam substrate in step 240 into a compression tool, such as a press, before using the polishing pad for CMP. In some instances, precompaction is preferable because precompacted polishing bodies provide a uniform removal rate when used for CMP. Of course, the entire polishing pad, and not just the polishing body could be precompacted. In certain cases, compressing comprises placing the thermoplastic foam substrate into a press in step 240 and applying a dwell pressure of least about 1 psi for a dwell time of at least about 1 minute. Consider, for instance, an embodiment where the thermoplastic foam substrate is a closed cell foam made of a PE-EVA copolymer and has a surface comprising concave cells coated with a TEOS-derived polishing agent. Preferred compression conditions for such a polishing body includes a dwell pressure of between about 5 and about 15 psi and a dwell time between about 5 and about 15 minutes.

Alternatively, in other instances, the polishing body, or more preferably the entire polishing pad, can be compacted in situ in step 250. In situ compaction refers to compression in a CMP tool during CMP itself in step 255. The extent of in situ compression depends on the magnitude of the down pressure and its duration, or dwell time, applied to semiconductor wafers during polishing. In situ compaction can be advantageous when it is desirable to adjust a polishing pad's removal rate and uniformity of removal while polishing different batches of wafers having different physical properties, or different desired post-CMP planarity characteristics. The use of a thermoplastic foam substrate is especially advantageous because the integrity of the substrate is maintained in a CMP environment long enough to allow in situ compression without pad decomposition. This is in contrast to a conventional thermoset material such as polyurethane pad, which is expected to rapidly decompose during polishing, before or during in situ compression, thereby resulting in unpredictable material removal rates and poor uniformities of removal.

While not limiting the scope of the invention by theory, in instances where the thermoplastic foam substrate comprises a closed-cell foam, compaction in steps 230 or 250 involves the out-gassing of substantially all of the blowing agent from the cells of thermoplastic foam substrate. Compaction 230, 250 also can involve applying a sufficient dwell pressure to cause mechanical failure of the thermoplastic foam substrate. In other instance, such as when the thermoplastic foam substrate is open-celled, it is preferable for the dwell pressure to be sufficient to cause mechanical failure of the thermoplastic foam substrate, resulting in a compacted thermoplastic foam substrate.

Certain preferred embodiments of the method for preparing the polishing pad also include a foaming process in step 260 to prepare a closed-cell thermoplastic foam substrate. The size of the cells within the substrate affects the size of the concave cells ultimately formed on the surface of the substrate in some embodiments. Several factors affect the size of the closed cells. As noted above, for example, the relative amounts of ethylene vinyl acetate copolymer and polyethylene may be controlled in order to advantageously adjust the size of cells produced during the foaming process 260. In addition, the kind of foaming process used may result in different cell sizes. Any foaming process well know to those of ordinary skill in the art may be used. The foaming process 260 may include, for example, blending the polymers comprising the substrate in a blender. The foaming process 260 can also include crosslinking polymers in the thermoplastic foam substrate, using irradiation or chemical means to achieve crosslinking. The foaming process 260 can further include forming a mixture of the substrate and a blowing agent, preferably under pressure, and extruding the mixture through a conventional die to form sheets of closed-cell foams. Of course, other conventional techniques well known to those of ordinary skill in the art can be use to prepare closed-cell or open-celled foams.

Certain preferred embodiments of the method for preparing the polishing pad further include a step 265 of exposing cells within the thermoplastic foam substrate to form a surface comprising concave cells and optional step 270 of coating an interior surface of the concave cells with a polishing agent. Cells within the uncompacted or the compacted thermoplastic foam substrate can be exposed by skiving or other conventional techniques to form the surface comprising concave cells. For example, exposing 265 may be achieved by fixing the thermoplastic foam substrate on a planar surface, and cutting a thin layer (i.e., between about 1200 microns and about 2000 microns) from the surface of the substrate. In certain preferred embodiments, skiving or cutting may be performed using a skiving device, such as those provided by Fecken-Kirfel, (Aachen, Germany).

Coating the interior surface the concave cells in step 270 can be achieved using the grafting procedure disclosed in the above-cited U.S. application Ser. No. 09/994,407. In certain embodiments, coating 270 may comprise exposing the interior surface to an initial plasma reactant to produce a modified surface thereon. Coating 270 can comprise exposing the modified surface to a secondary plasma reactant to create a grafted surface on the modified surface, the grafted surface comprising the polishing agent. Any of the primary and secondary reactants or procedures described above or in U.S. patent application Ser. No. 09/994,407 can be used in the grafting process to coat the polishing agent on the interior surface of the concave cells of the substrate of the present invention.

In certain preferred embodiments, the method for preparing the polishing pad, includes a step 275 of coupling the thermoplastic foam substrate to a stiff backing material, such as those backing materials described above. In certain embodiments, coupling 275 is achieved via chemical bonding using a conventional adhesive, such as epoxy or other materials well known to those skilled in the art. In other preferred embodiments, coupling 275 is achieved via extrusion coating of the molten backing material onto the foam. In still other embodiments, the backing is thermally welded to the thermoplastic foam substrate.

Figure 3:
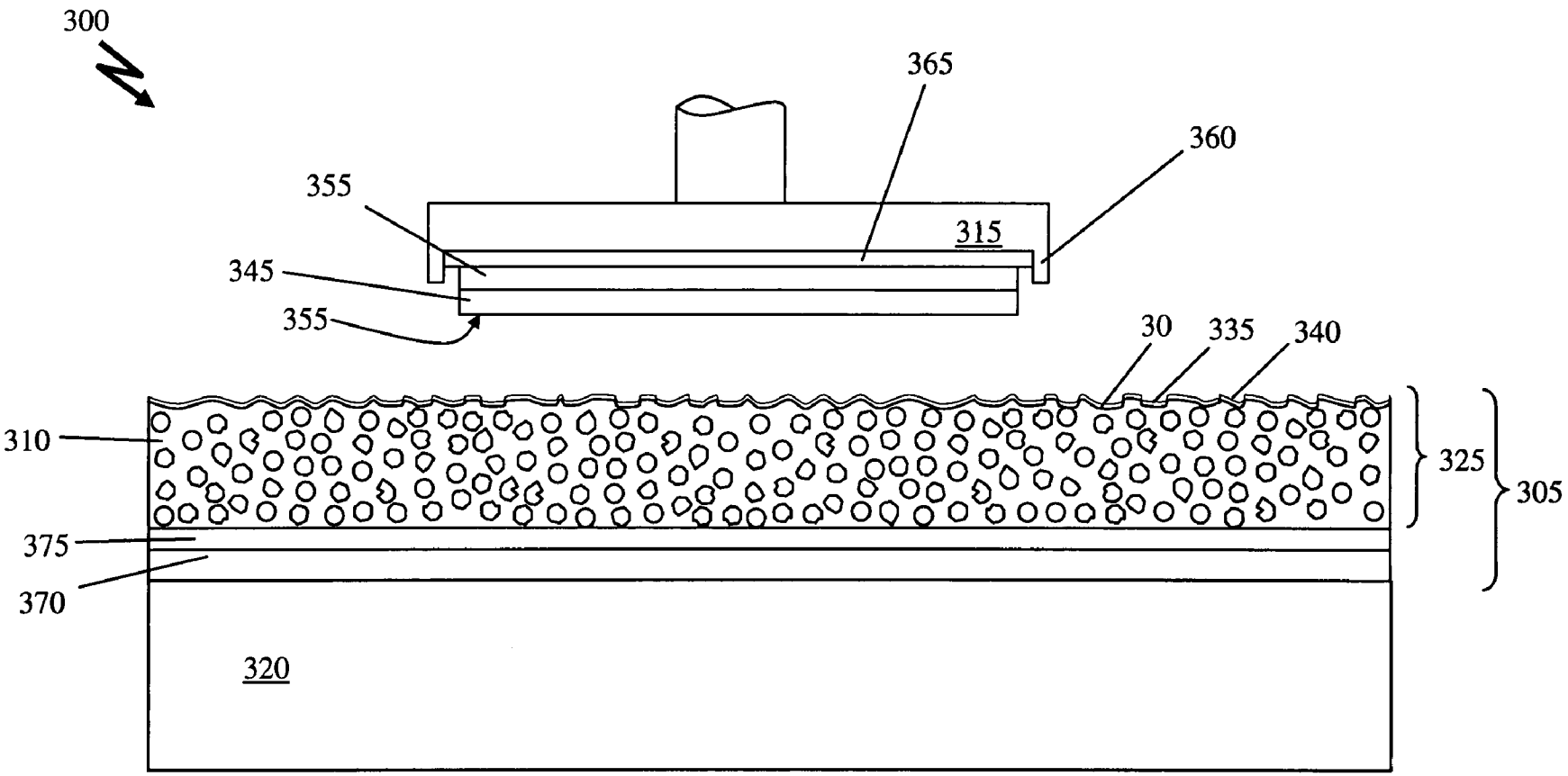
FIG. 3 illustrates a polishing apparatus, including a chemical mechanical polishing pad fabricated according to the principles of the present invention.

Yet another embodiment of the present invention is a polishing apparatus. FIG. 3 illustrates a polishing apparatus 300, including a polishing pad 305 fabricated using a thermoplastic foam substrate 310 made according to the principles of the present invention. The polishing apparatus 300 comprises a mechanically driven carrier head 315, a polishing platen 320, the carrier head 315 being positionable against the polishing platen 320 to impart a polishing force against the polishing platen 320. The apparatus 300 further includes the polishing pad 305 attached to the polishing platen 320. The polishing pad 305 includes a polishing body 325 comprising a compacted thermoplastic foam substrate 310 that has a density that is at least about 1.1 times greater than an uncompacted thermoplastic foam substrate density. Any of the thermoplastic foam substrates and methods described above can be used to form the compacted thermoplastic foam substrate 310. Similarly, the compacted thermoplastic foam substrate 310 can further include any of the above-described embodiments of a surface comprising concave cells 330 and a polishing agent 335 coating an interior surface 340 of the concave cells 330.

In certain preferred embodiments, the polishing pad 305 is capable of polishing a metal 345 on a device substrate 350 surface 355 at a removal rate of at least about 500 Angstroms/minute the removal rate being attained in about 2 minutes cumulative polishing time and maintained for at least about 300 minutes cumulative polishing time. The term cumulative polishing time as used herein, refers to the total time the polishing pad 305 is used to successively polish multiple surfaces 355, such as the surface 355 of any number of the device substrates 350, such as semiconductor devices on wafers. For example, when the metal 345 is tungsten, the removal rate can be attained and sustained for the above-cited cumulative polishing time, when using a down pressure between about 4 and about 8 psi, a table speed between about 20 and 100 rpm and a carrier speed between about 20 and about 110 rpm. Similar results are expected for the polishing of copper surfaces.

In other preferred embodiments, the removal rate of the metal 345 during polishing of the device surface 355 remains within about ±20%. Moreover, the removal rate may be attained in about 150 minutes cumulative polishing time and maintained for at least about 300 minutes cumulative polishing time. In still other preferred embodiments, the metal 345 is selected from the group consisting of copper and tungsten. In particular preferred embodiments, the metal 345 comprises tungsten, and the device surface, after polishing, has a defect density corresponding to less than about 500 counts/200 mm wafer.

Additional embodiments of the polishing apparatus 300 may include a conventional carrier ring 360 and adhesive 365 to securely couple the substrate 350 to the carrier head 315. The polishing body 325 can further include a stiff backing material 370 coupled to the compacted thermoplastic foam substrate 310, for example using a conventional second adhesive 375.

Having described the present invention, it is believed that the same will become even more apparent by reference to the following experiments. It will be appreciated that the experiments are presented solely for the purpose of illustration and should not be construed as limiting the invention. For example, although the experiments described below may be carried out in a laboratory setting, one skilled in the art could adjust specific numbers, dimensions and quantities up to appropriate values for a full-scale plant setting.

Experiments

Experiments were conducted to characterize the polishing properties of pad that have been in situ compacted and precompacted, and to evaluate the density of compacted polishing pad using acoustic transmittance measurements.

The polishing pads comprised a polishing body laminated to a backing material comprising an about 0.03 inch thick condensed HDPE layer (hardness about 90 shore A). Coupling between the polishing body and the backing material was achieved via extrusion coating of the molten HDPE on a prefabricated roll of thermoplastic foam. To affix the polishing pad to a polishing table, the backing material was backed with a pressure sensitive adhesive (3M product number 9731). The polishing body comprised a thermoplastic foam substrate comprised 0.070" EVA-PE foam (Volextra™ from Voltek) having a hardness of about 30 shore A. The thermoplastic foam substrate comprised ~12 weight percent talc, ~18 weight percent EVA and balance PE. About 9 percent of the thermoplastic foam substrate's volume comprised cells. After skiving, the polishing body was about 64 mil thick and had a surface comprising concave cells and a polishing agent comprising an about 500 micron thick layer of amorphous $SiO_2$ coating an interior surface of the concave cells via plasma enhanced CVD as further described below. The polishing body was laser scored to afford slurry channels.

The thermoplastic foam substrate was skived with a commercial cutting blade (Model number D5100 K1, from Fecken-Kirfel, Aachen, Germany) and then manually cleaned with an aqueous/isopropyl alcohol solution. To coat the substrate with polishing agent comprising silicon dioxide, the skived substrate was placed in the reaction chamber of a conventional commercial Radio Frequency Glow Discharge (RFGD, Model PE-2; Advanced Energy Systems, Medford, N.Y.) plasma reactor having a temperature controlled electrode configuration.

The plasma treatment of the substrate was commenced by introducing the primary plasma reactant, Argon, for about 30 to about 120 seconds, depending on sample size and rotation speed, within the reaction chamber maintained at about 350 mTorr. The electrode temperature was maintained at about 30° C., and a RF operating power of about 100 to about 2500 Watts was used, depending on the sample and reaction chamber size.

Subsequently, the secondary reactant was introduced for either 10 or 30 minutes at 0.10 SLM and consisted of the silicon dioxide metal ester precursor, tetraethoxysilane (TEOS), mixed with He or Ar gas. The amount of precursor in the gas stream was governed by the vapor pressure (BP) of the secondary reactant monomer at the monomer reservoir temperature (MRT; 90±10° C.). Similar procedures were used to prepare polishing bodies coated with a polishing agent comprising $TiO_2$, using a secondary plasma reactant containing tetraorthotitinate.

Tungsten polishing properties were assessed using a commercial polisher Product No. EP0222 (Ebara Technologies, Sacramento, Calif.). No preconditioning was performed on the pad prior to commencing the experiment. Unless otherwise noted, the removal rate of tungsten polishing was assessed using a down force of about 20 kPa (~3 psi), back side pressure of about 6.9 kPa (~1 psi) a table speed of about 25 rpm, a carrier speed of about 40 rpm and slurry flow rate of about 125 ml/min. About 10,000 Angstrom thick wafers having an about 8,000 Angstrom thick tungsten layer were used for test polishing. The polishing properties of the polishing pads, were examined in a slurry environment comprising colloidal acidic buffer, silica and hydrogen peroxide (SSW2000, from Cabot Microelectronics, Aurora, Ill.) mixed deionized water and hydrogen peroxide to afford 50% w/w SSW2000 and ~2% $H_2O_2$.

Figure 4:
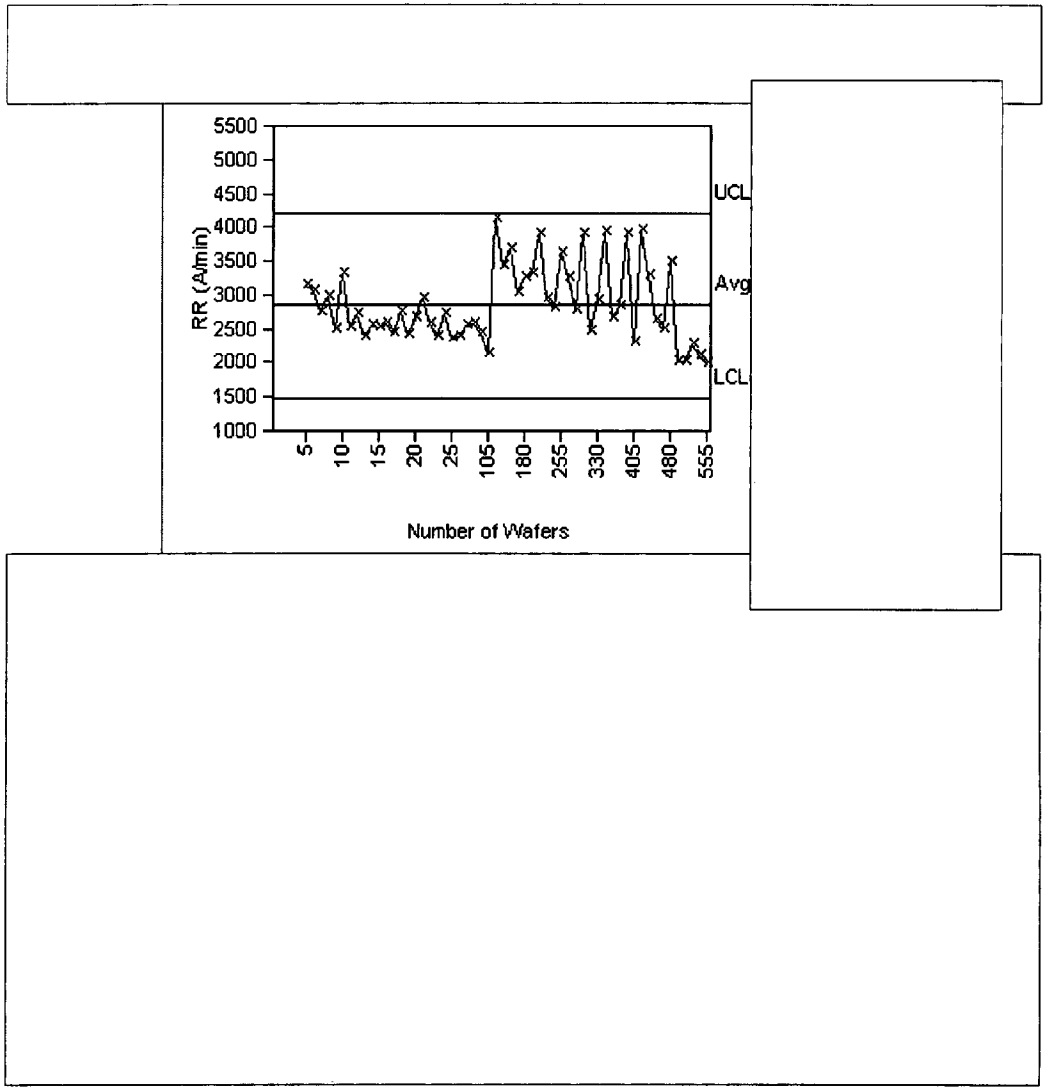
FIG. 4 presents representative tungsten removal rates (RR) from a semiconductor wafer, using an exemplary in situ compacted polishing pad.

FIG. 4 presents representative blanket tungsten removal rates (RR) for a plurality of semiconductor wafers, using an exemplary in situ compacted polishing pad prepared as described above. By virtue of compression from a down pressure (DP) of about 5 psi being applied during individual wafer for polishing dwell time (DT) of 100 minutes, the polishing pad is compacted after polishing about 100 wafers. As illustrated in FIG. 4, for wafers 100 to 500, the in situ compacted polishing pad removes tungsten at an elevated rate as compared to the uncompacted, or incompletely compacted, polishing pad. The average removal rate (Avg) was about 2860 Angstroms/minute. The inter-wafer removal rate stayed within an upper control limit (UCL) of about 4200 Angstroms/minute and lower control limit (LCL) of about 1500 Angstroms/minute (represented by the horizontal lines). After polishing approximately 555 wafers, the removal rate dropped below the LCL, and the experiment was halted.

Further experiments were done to assess the removal rate of tungsten from the surface of a plurality of semiconductor wafers using pre-compacted polishing pads. Polishing pads similar to that described above, prior to CMP, were placed in a press (Custom press, Cajoromi, Orangeville, Ontario, Canada). The press applied a preselected weight load (referred to herein as a down force, DF, in units of lbs) for a predetermine compression dwell time (DTc). An exemplary polishing pad, whose data is shown in FIGS. 2A and 2B, the polishing pad was compressed at a DF of about 1800 lbs for a DTc of about 10 minutes. The compacted polishing pad was then used to polish tungsten-covered wafers similar to that described above.

Figure 5:
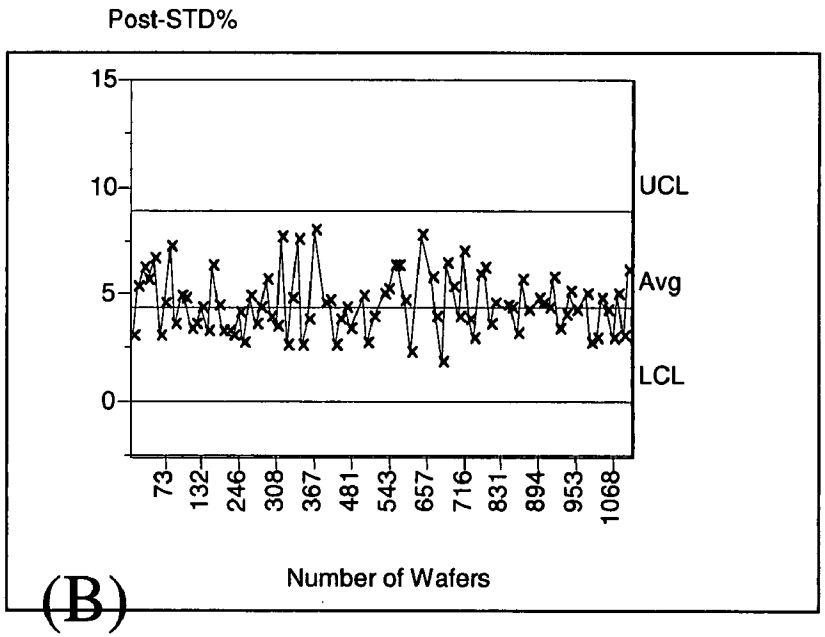
FIG. 5 illustrates: (A) the removal rate (RR) of tungsten from the surface of semiconductor wafers, and (B), the uniformity of the surface of polished semiconductor wafers (Post STD), using a precompacted polishing pad.
Figure 5:
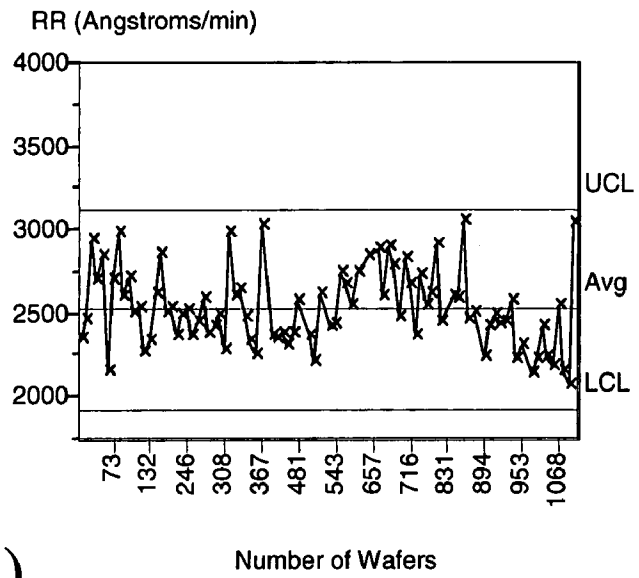

As shown in FIG. 5A, the average blanket tungsten removal rate of about 2525 Angstroms/minute, was comparable to the in situ compacted polishing pad such depicted in FIG. 4. Moreover, a narrower UCL and LCL (about 3120 and about 1930 Angstroms/minute, respectively) was attained for about double the number of wafers polished using the in situ compacted polishing pad. FIG. 5B presents the same data shown in FIG. 5A, illustrating the uniformity of the surface of polished semiconductor between wafers, presented as a percent standard deviation (Post STD). For the polishing pad depicted in FIG. 5B the average Post STD equaled about 4.5%.

Figure 6:
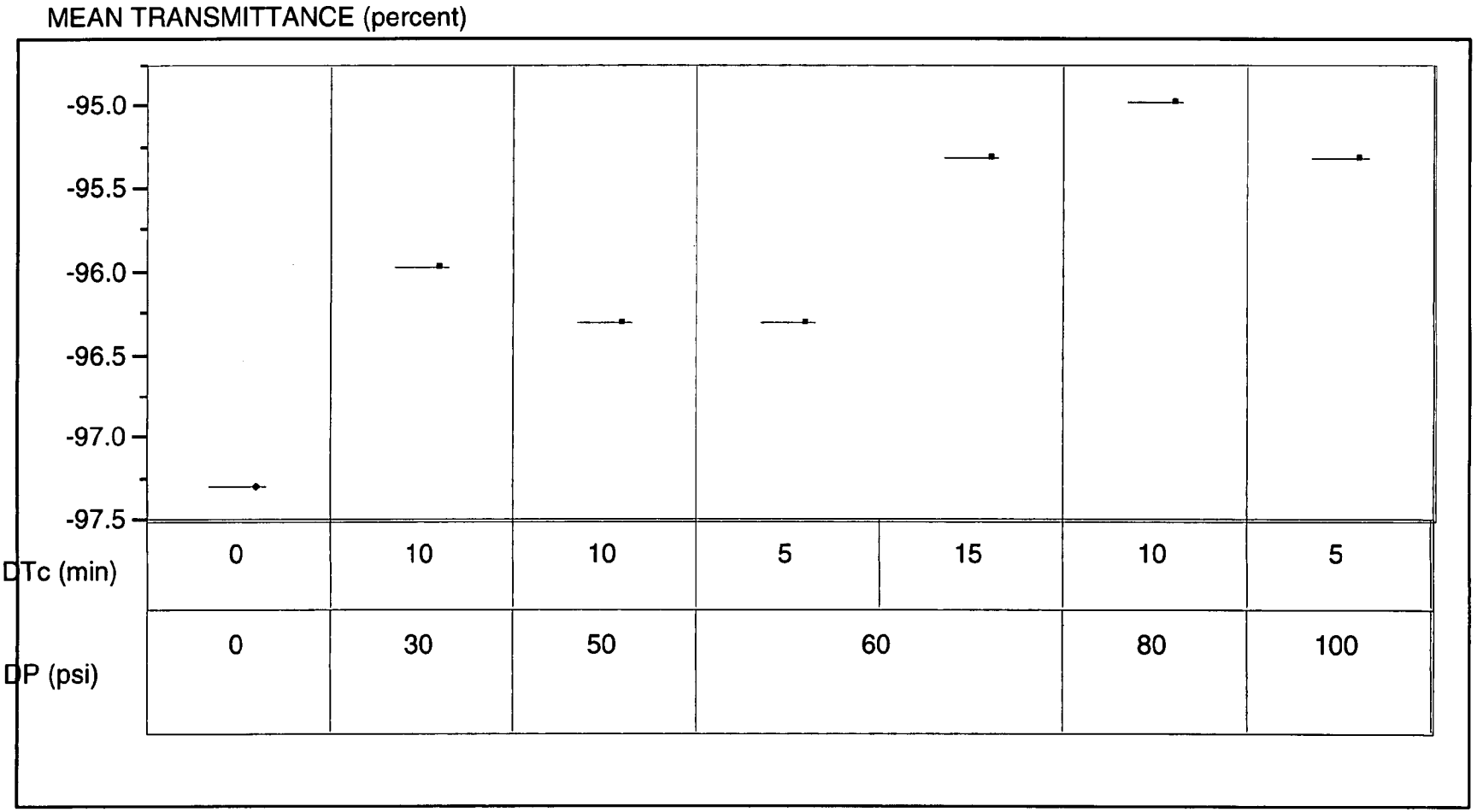
Figure 7:
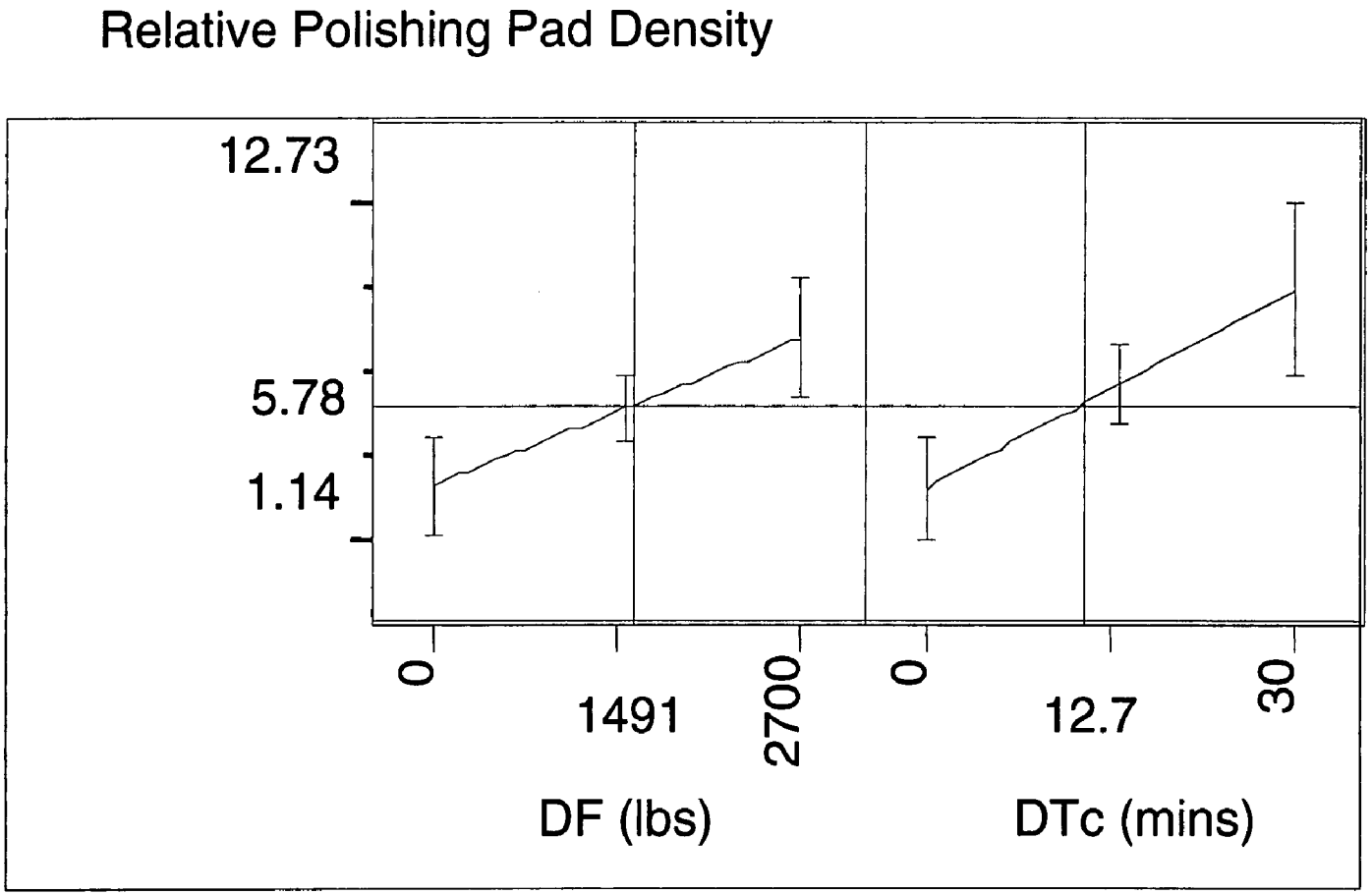
FIG. 7 presents exemplary results from a nonlinear least squares analysis of acoustic transmittance data to predict a relationship between a polishing pad density and an applied down force (DF) and dwell time (DT)
Figure 8:
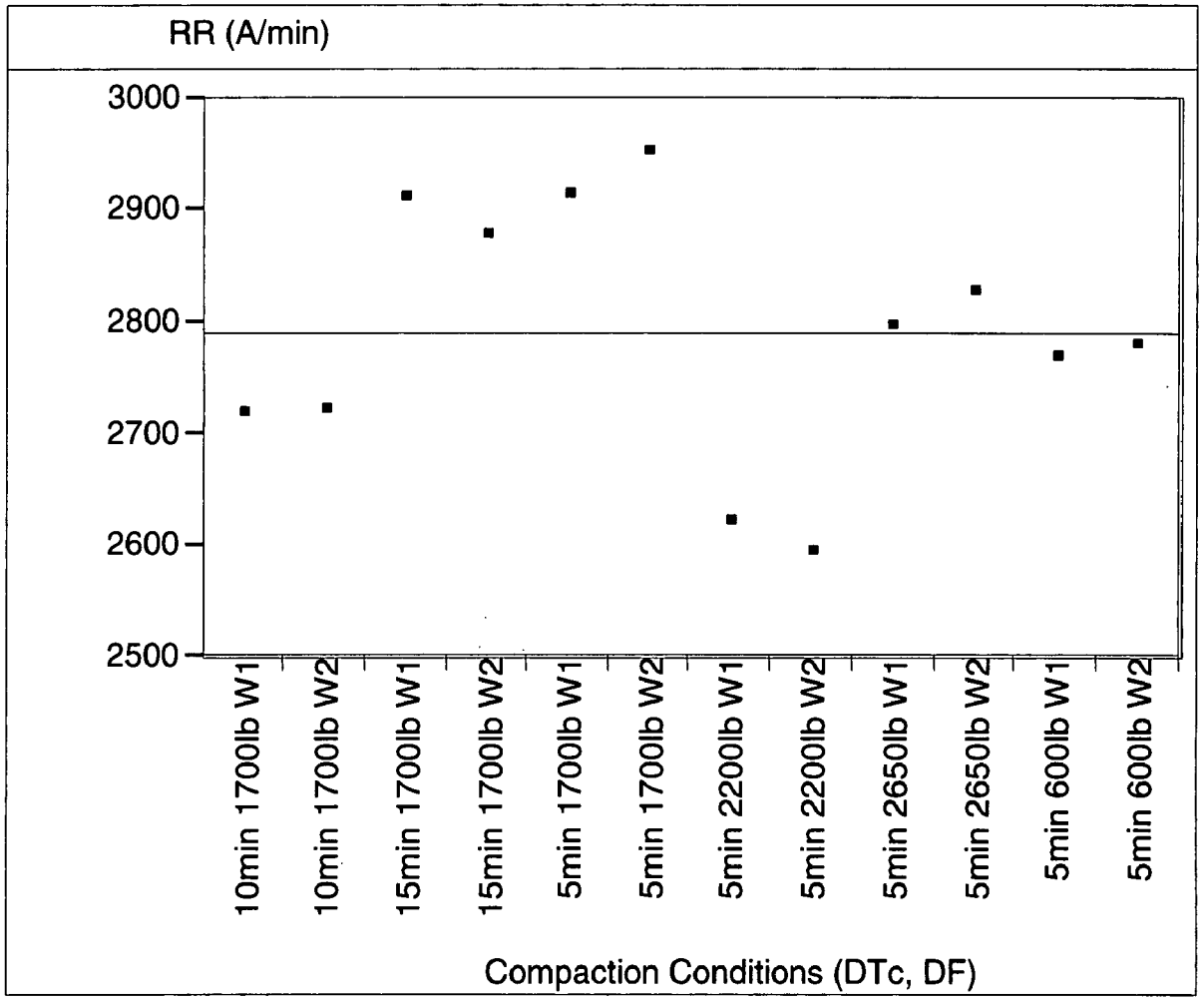
FIG. 8 presents exemplary data to illustrate the relationship between the tungsten removal rates from semiconductor wafers (W1, W2) using precompacted polishing pads with various down forces (DF) and dwell times (DT)

It is convenient to compare the change in density of polishing pads or polishing bodies before and after compaction using acoustic transmittance measurements. Acoustic transmittance was measured with a commercially available transducer and subsystem components (SecondWave Systems, Boalsburg, Pa.) using a transmitted signal at ~0.1 MHz and ~1 MHz. It was found that the relative change in acoustic transmittance the polishing pad before and after compaction is directly proportional to the change in density of the pad. FIG. 6 presents exemplary data to illustrate the relationship between the mean acoustic transmittance of different polishing pads similar to that described above, after being subject to various DPs for different DTc imparted by the press. A DP and DTc equal to zero correspond to an uncompacted polishing pad. FIG. 7 presents exemplary results from a nonlinear least squares analysis of acoustic transmittance data, such as presented in FIG. 6, to predict a relationship between relative polishing pad density and a DF and DTc. The optimization of the compression conditions can be further refined and tested by measuring the removal rates obtained using compacted polishing pads prepared for a range of conditions of DF and DTc, such as illustrated in FIG. 8. Such data can be analyzed using statistical methods, such as one-way analysis of variance, to predict the optimal compression conditions to produce a compacted polishing pad having the optimal combination of high removal rates and low between-wafer uniformity of removal. For instance, using the above-described polishing pads to remove tungsten, compression conditions corresponding to a DF of about 1800 lbs for a DTc of about 10 minutes is predicted to be optimal. Of course, the compression conditions would have to be optimized for the particular CMP conditions of interest, including the specific polishing tool or slurry being used, or surface being planarized.

Another consideration in the assessment of compacted polishing bodies or compacted polishing pads is the quality of planarization within each wafer polished. The within wafer nonuniformity (WIWNU) of tungsten removal across the wafer's surface was assessed using the same polishing apparatus and conditions as described above. Contour plots of the tungsten surfaces after polishing were measured electrically by measuring sheet resistance at 49 points distributed radially across the wafer. The average post-polishing depths of tungsten removed across individual wafers was calculated as a removal rate (WIWRR) and the percent standard deviation (% std) of the depth removed (WIWNU) were calculated from the 49 measured of sheet resistance.

Figure 9:
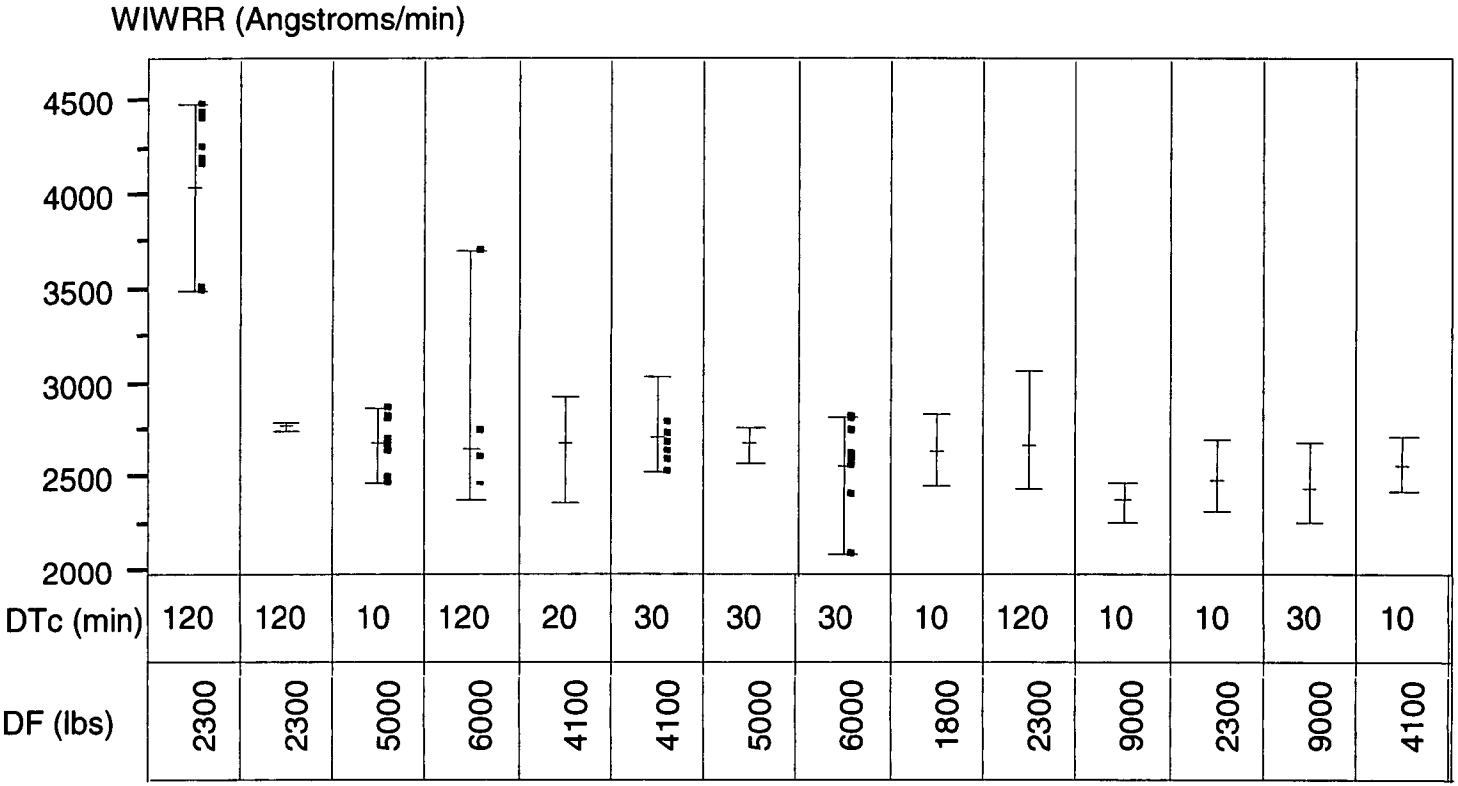
FIG. 9 shows representative mean wafer tungsten removal rate data illustrating the mean within wafer removal rates (WIWRR) across individual tungsten-layered wafers, using differently precompacted polishing pads.
Figure 10:
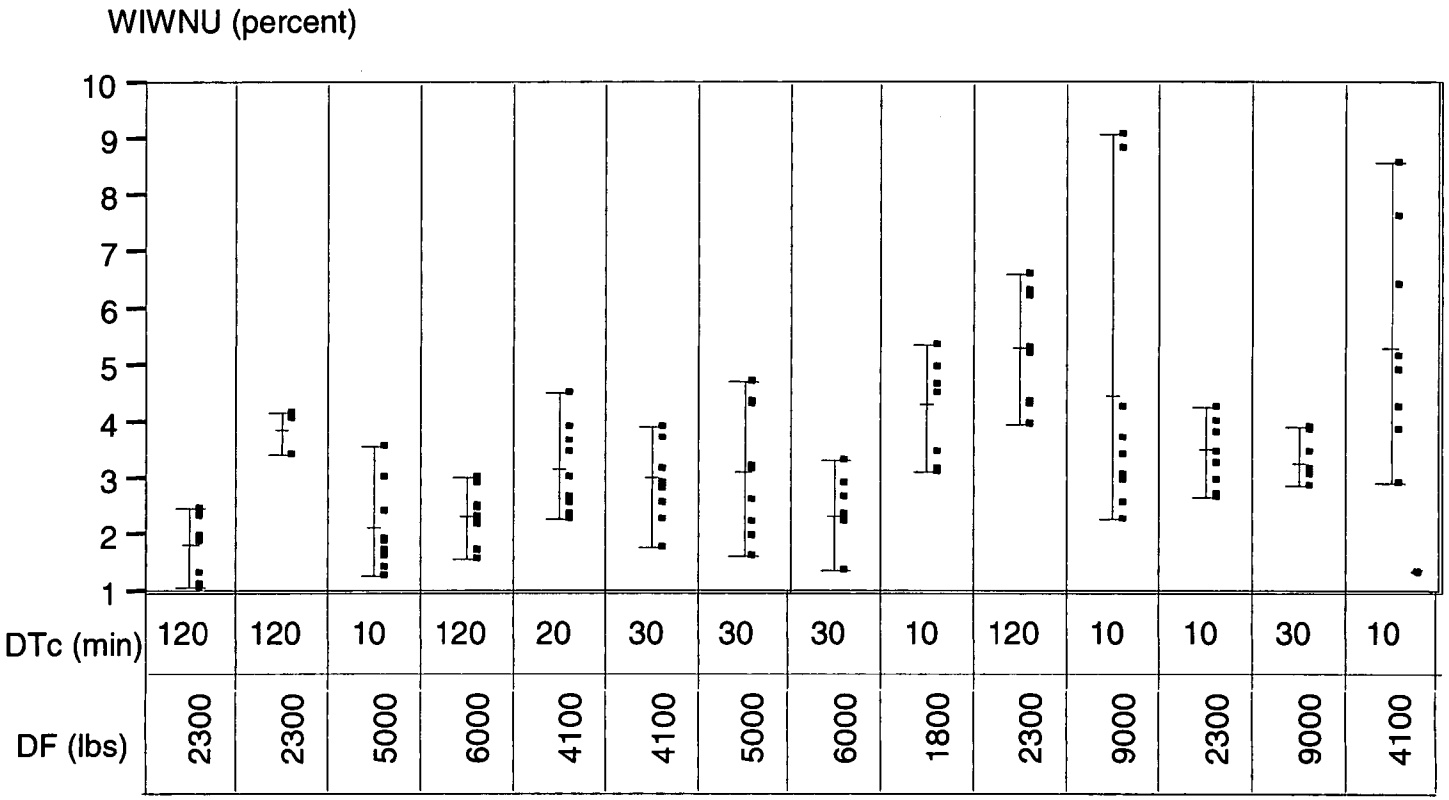
FIG. 10 illustrates representative within wafer nonuniformity (WIWNU) in the removal rate of tungsten from wafer surfaces using different precompacted polishing pads.

FIG. 9 shows representative mean wafer tungsten removal rate data illustrating the mean WIWRR across individual tungsten-layered wafers, using different precompacted polishing pads. FIG. 10 illustrates representative within wafer nonuniformity (WIWNU) in the removal rate of tungsten from wafer surfaces for the same precompacted polishing pads depicted in FIG. 9. Such data can be used to further refine the compression conditions used to prepare compacted polishing pads or compacted polishing bodies.

Although the present invention has been described in detail, those skilled in the art should understand that they can make various changes, substitutions and alterations herein without departing from the scope of the invention.

What is claimed is:

1. A chemical mechanical polishing pad, comprising:

a polishing body and a backing material coupled to said polishing body, said polishing body comprising a compacted thermoplastic foam substrate, wherein said compacted thermoplastic foam substrate has a density that is as at least about 1.1 times greater than an uncompacted thermoplastic foam substrate density.

2. The polishing pad as recited in claim 1, wherein said density is at least about 2 times greater than said uncompacted thermoplastic foam substrate density.

3. The polishing pad as recited in claim 1, wherein said density is between about 1 $lb/ft^3$ and about 25 $lb/ft^3$.

4. The polishing pad as recited in claim 1, wherein said density is between about 5 $lb/ft^3$ and about 15 $lb/ft^3$.

5. The polishing pad as recited in claim 1, wherein said compacted thermoplastic foam substrate comprise a closed-cell foam of crosslinked homopolymer or copolymers.

6. The polishing pad as recited in claim 5, wherein cells of closed-cell foam are substantially devoid of a blowing agent.

7. The polishing pad as recited in claim 5, wherein cells of closed-cell foam have 10 percent or less of a blowing agent as compared to that found in an uncompacted thermoplastic foam substrate.

8. The polishing pad as recited in claim 1, wherein said compacted thermoplastic foam substrate comprise an open-cell foam of crosslinked homopolymer or copolymers.

9. The polishing pad as recited in claim 1, wherein said thermoplastic foam substrate comprises a cross-linked polyethylene.

10. The polishing pad as recited in claim 1, wherein said thermoplastic foam comprises cross-linked copolymers comprising polyethylene and ethylene vinyl acetate.

11. The polishing pad as recited in claim 1, wherein said thermoplastic foam comprises blend of crosslinked ethylene vinyl acetate copolymer and a low-density polyethylene copolymer.

12. A method for preparing a chemical mechanical polishing pad, comprising:

providing an uncompacted thermoplastic foam substrate; and compressing said uncompacted thermoplastic foam substrate such that a compacted thermoplastic foam substrate has a density that is as at least about 1.1 times greater than said uncompacted thermoplastic foam substrate.

13. The method as recited in claim 12, wherein said compressing comprises placing said thermoplastic foam substrate into a press and applying a pressure of least about 1 psi for a dwell time of at least about 1 minute.

14. The method as recited in claim 12, wherein said pressure is between about 5 and about 15 psi and said dwell time is between about 5 and about 15 minutes.

15. The method as recited in claim 12, further including exposing cells within said uncompacted thermoplastic foam substrate to form a surface comprising concave cells.

16. The method as recited in claim 12, further including exposing cells within said compacted thermoplastic foam substrate to form a surface comprising concave cells.

17. The method as recited in claim 12, wherein said compacted thermoplastic foam substrate is coupled to a backing material comprising a high-density polyethylene.

18. The method as recited in claim 12, wherein said compressing is accomplished in situ by applying a down pressure to said polishing pad in a CMP tool.

19. A polishing apparatus, comprising:

a mechanically driven carrier head;

a polishing platen, said carrier head being positionable against said polishing platen to impart a polishing force against said polishing platen; and a polishing pad attached to said polishing platen and including a polishing body comprising:

a compacted thermoplastic foam substrate wherein said compacted thermoplastic foam substrate has a density that is as at least about 1.1 times greater than an uncompacted thermoplastic foam substrate density.

20. The polishing apparatus as recited in claim 19, wherein said polishing pad is capable of polishing a metal from a plurality of semiconductor surfaces at a removal rate of at least about 500 Angstroms/minute said removal rate being attained in about 2 minutes cumulative polishing time and maintained for at least about 300 minutes cumulative polishing time.

21. The polishing apparatus as recited in claim 19, wherein said removal rate of said metal during polishing of said semiconductor surfaces remains within about ±20%, said removal rate being attained in less than about 150 minutes cumulative polishing time and maintained for at least about 300 minutes cumulative polishing time.

* * * * *